US006453812B1

(12) United States Patent
Ikeda et al.

(10) Patent No.: US 6,453,812 B1
(45) Date of Patent: Sep. 24, 2002

(54) INK SUPPLY CONTROL DEVICE FOR PRINTING MACHINES AND A METHOD THEREFOR

(75) Inventors: Hideki Ikeda; Hiroshi Sugimoto; Yukio Ejiri, all of Fuchu (JP)

(73) Assignee: Ryobi, Ltd., Hiroshima-ken (JP)

( * ) Notice: Subject to any disclaimer, the term of this patent is extended or adjusted under 35 U.S.C. 154(b) by 0 days.

(21) Appl. No.: 09/522,532

(22) Filed: Mar. 10, 2000

(30) Foreign Application Priority Data

Mar. 10, 1999 (JP) ..... 11-062965

(51) Int. Cl.[7] ..... B41F 31/02
(52) U.S. Cl. ..... 101/365; 101/484
(58) Field of Search ..... 101/350.5, 364, 101/365, 484, 492

(56) References Cited

U.S. PATENT DOCUMENTS 4,573,190 A * 2/1986 Tsunoda et al. ..... 101/365
5,031,535 A * 7/1991 Kipphan et al. ..... 101/365
5,052,298 A * 10/1991 Runyan et al. ..... 101/365
5,103,728 A * 4/1992 Barney ..... 101/364
5,447,102 A * 9/1995 Pfeiffer et al. ..... 101/492
5,967,049 A * 10/1999 Seymour et al. ..... 101/365
6,006,668 A * 12/1999 Rehmann ..... 101/484

FOREIGN PATENT DOCUMENTS

| | | |
|---|---|---|
| CA | 1 137 597 | 12/1982 |
| DE | 29 22 964 | 12/1979 |
| JP | 10-16193 | 1/1998 |

* cited by examiner

*Primary Examiner*—Eugene Eickholt
(74) *Attorney, Agent, or Firm*—Merchant & Gould P.C.

(57) ABSTRACT

Prior to printing work, the operator of the printing machine selectively inputs a kind of the printing paper (such as one of coated paper, mat-coated paper, and non-coated paper and so on) through a paper-type input portion 17. A CPU 11 controls the supply of ink according to the type of printing paper to be used as a result of controlling one of the operation of ink fountain keys, an ink fountain roller, and an ink ductor roller using an ink fountain key controller 21, an ink fountain roller controller 22, and an ink ductor roller controller 23.

6 Claims, 9 Drawing Sheets

FIG.6

| KIND OF PAPER | PAPER COEFFICIENT |
|---|---|
| COATED PAPER | 1 |
| MAT-COATED PAPER | 1. 1 |
| NON-COATED PAPER | 1. 2 |

INK SUPPLY CONTROL DEVICE FOR PRINTING MACHINES AND A METHOD THEREFOR

CROSS REFERENCE TO RELATED APPLICATIONS

All of the contents disclosed in Japanese Patent Application No. HI 1-62965 (filed on Mar. 10, 1999), including specification, claims, drawings and abstract, are incorporated into the present application by cross-reference to all these disclosed contents.

BACKGROUND OF THE INVENTION

1. Field of the Invention

The present invention relates to an ink supply control device for printing machines and a method for controlling ink supply.

2. Description of the Prior Art

A conceptual view of an ink supply device for printing machines is illustrated in FIG. 9. FIG. 9 is a side view of an inking unit 50, a plate cylinder 6, a dampening device 29 and so on included in a printing machine. An ink fountain 2 includes both an ink fountain roller 4 and a blade 3, and the blade 3 comprises a plurality of ink fountain keys divided in the direction of a roller shaft 4J of the ink fountain roller 4. The ink 10 stored in the ink fountain 2 is fed on the external surface of the ink fountain roller 4 through gaps formed between the keys and the roller 4.

An ink ductor roller 5 situated at a position between an ink roller 31 of an ink roller group 30 and the ink fountain roller 4, is reciprocally moved in both directions of arrows 91 and 92, so that the ink 10 fed on the external surface of the ink fountain roller 4 is transferred onto the ink roller 31. The ink 10 thus transferred is finally supplied to a printing plate 7 disposed on a plate cylinder 6 as a result of sequentially distributing the ink 10 onto each of ink rollers in the group 30. The dampening device 29 is a device for supplying dampening solution to the printing plate 7.

In this way, both the ink and the dampening solution are supplied to the printing plate 7. Image(s) on the printing plate 7 is transferred on a printing paper through a rubber blanket cylinder 8 as a result of using repulsion occurring between the ink and the dampening solution both supplied to the plate 7.

A conventional method of controlling ink film thickness is disclosed in Japanese laid-open publication No. Hei 10-16193. In the control method, ink films in the minimum thickness required for carrying out printing work are formed on the ink rollers as a result of feeding the ink 10 from the keys uniformly opened when the printing work is carried out under a condition of not distributing the ink on the group 30.

Thereafter, a certain volume of the ink 10 corresponding to the image(s) on the printing plate is further distributed on the ink films in an axial direction by setting both an opening degree of each key and rotating amount of the ink fountain roller at values corresponding to the image(s) on the printing plate.

The conventional control method, however, has the following problems to be solved. These are various kinds of printing papers such as coated papers, mat coated papers and non-coated papers.

With coated papers, the printing work can be carried out with a less volume of ink because the coated printing papers have a good ink film transferability. With non-coated papers, on the contrary, a larger volume of ink needs to be supplied for carrying out the printing work because the non-coated printing papers have a poor ink film transferability. Further, mat coated papers have an intermediate ink film transferability between the coated papers and the non-coated papers. In general, non-coated papers are frequently used as printing papers because of a price lower than that of coated papers.

Although a different volume of ink is required depending upon the kind of papers, an appropriate control of the ink supply with certainty corresponding to the kind of papers can not be performed in the ink supply of the prior art printing machine.

In other words, the operator of the machine has to adjust the ink volume in accordance with the printing papers to be used at every time when the kind of printing papers is changed to another. That is, the operator must reset the opening degree of the keys, the rotating amount of the ink fountain roller, and the number of the reciprocal movement of the ink ductor roller 5 at every change of printing paper. To make the matter worse, the operator must select optimum values from the stored values based on his/her experience.

It takes a long time to carry out control of the ink supply corresponding to the kind of papers in the prior art ink supply. An appropriate control of the ink supply with certainty can not be expected all the time if the control is performed based on the operator's experience.

SUMMARY OF THE INVENTION

It is an object of the present invention to provide an ink supply control device and a method therefore capable of carrying out appropriate controls with certainty in accordance with the kind of the printing paper.

In accordance with characteristics of the present invention, there is provided an ink supply control device for printing machines including an ink supply portion for supplying ink to a printing plate, the device further comprising:

a paper coefficient storing portion for storing a plurality of paper coefficient uniquely determined corresponding to kinds of printing papers; and an input portion for inputting a kind of the printing paper to be printed, wherein a paper coefficient corresponding to the kind of the printing paper inputted through the input portion is selected from the paper coefficient stored in the paper coefficient storing portion, and wherein the ink supply portion controls supply of an ink volume to the printing plate in accordance with the selected coefficient.

While the novel features of the invention are set forth in a general fashion, both as to organization and content. Other objects and features of the present invention will be more apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

BRIEF DESCRIPTION OF THE DRAWINGS

FIG. 6 is a table representing a relationship between kind of papers to be printed and paper coefficient stored in the ROM 12;

DETAILED DESCRIPTION OF THE PREFERRED EMBODIMENTS

1. First Embodiment

Figure 1:
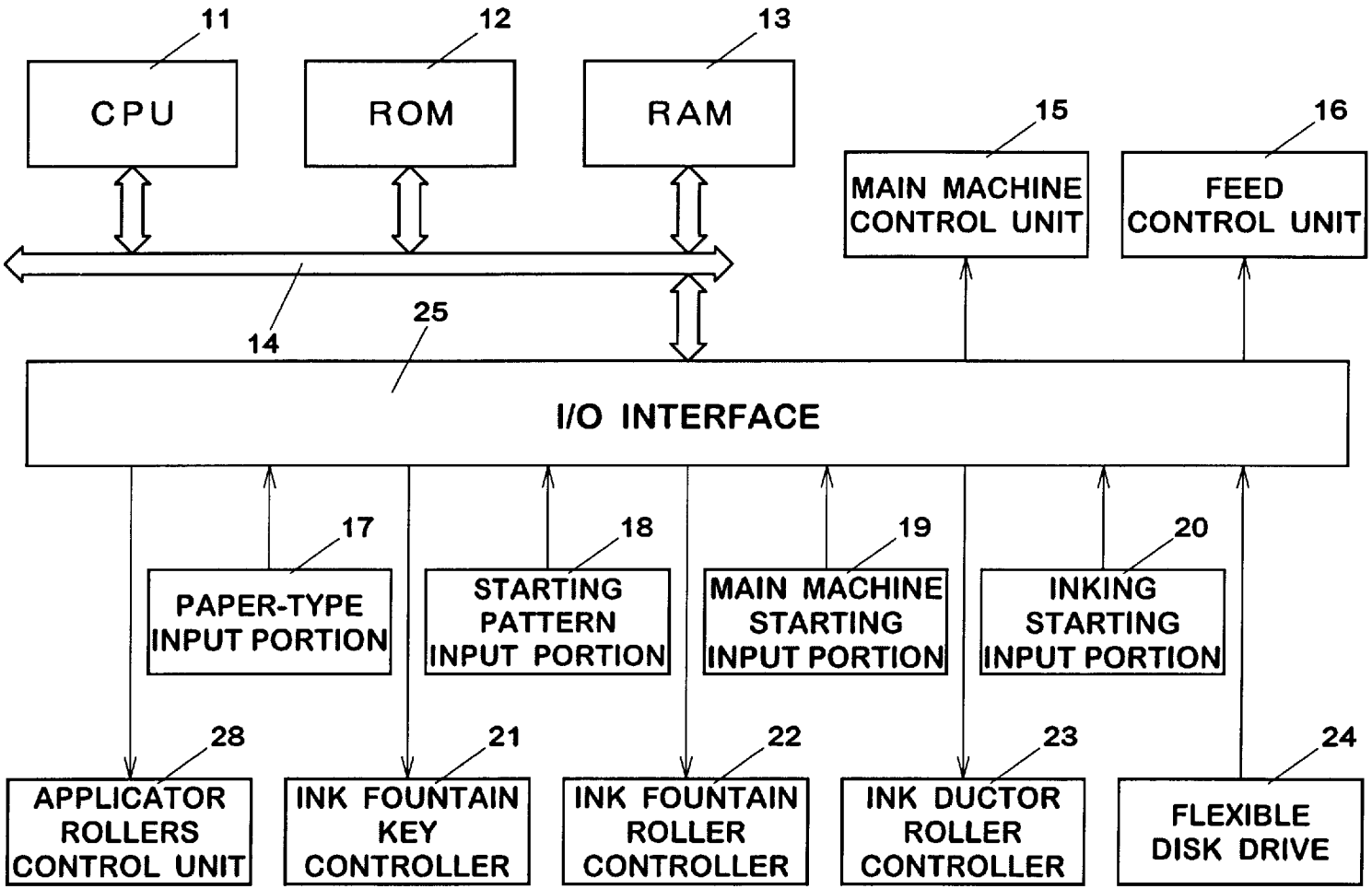
FIG. 1 is a diagram showing a hardware structure of the main portion of an inking unit 50 forming the first embodiment of the ink supply control device and the method therefor according to the present invention.
Figure 2:
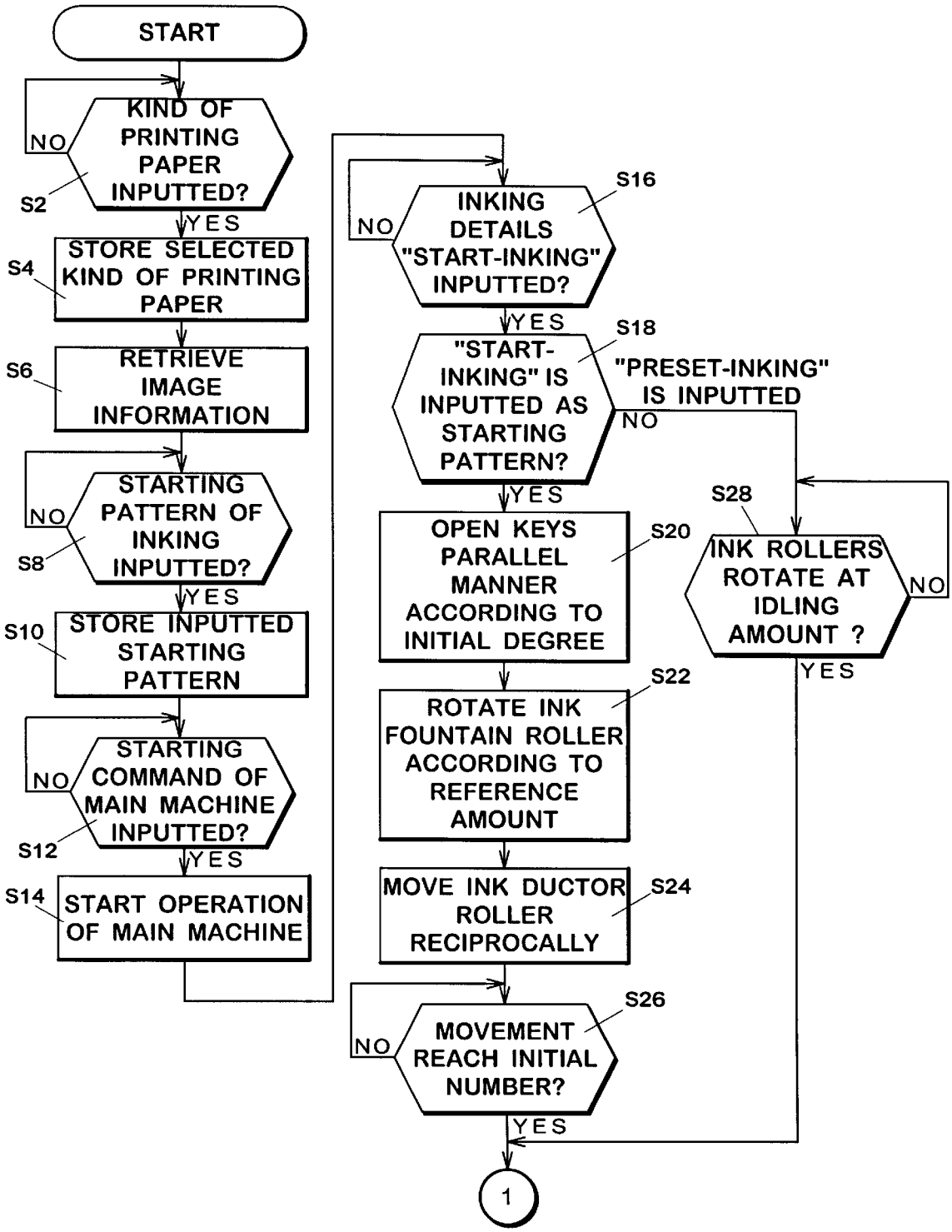
FIG. 2 is a flow chart disclosing a program stored in a ROM 12 shown in FIG. 1.
Figure 3:
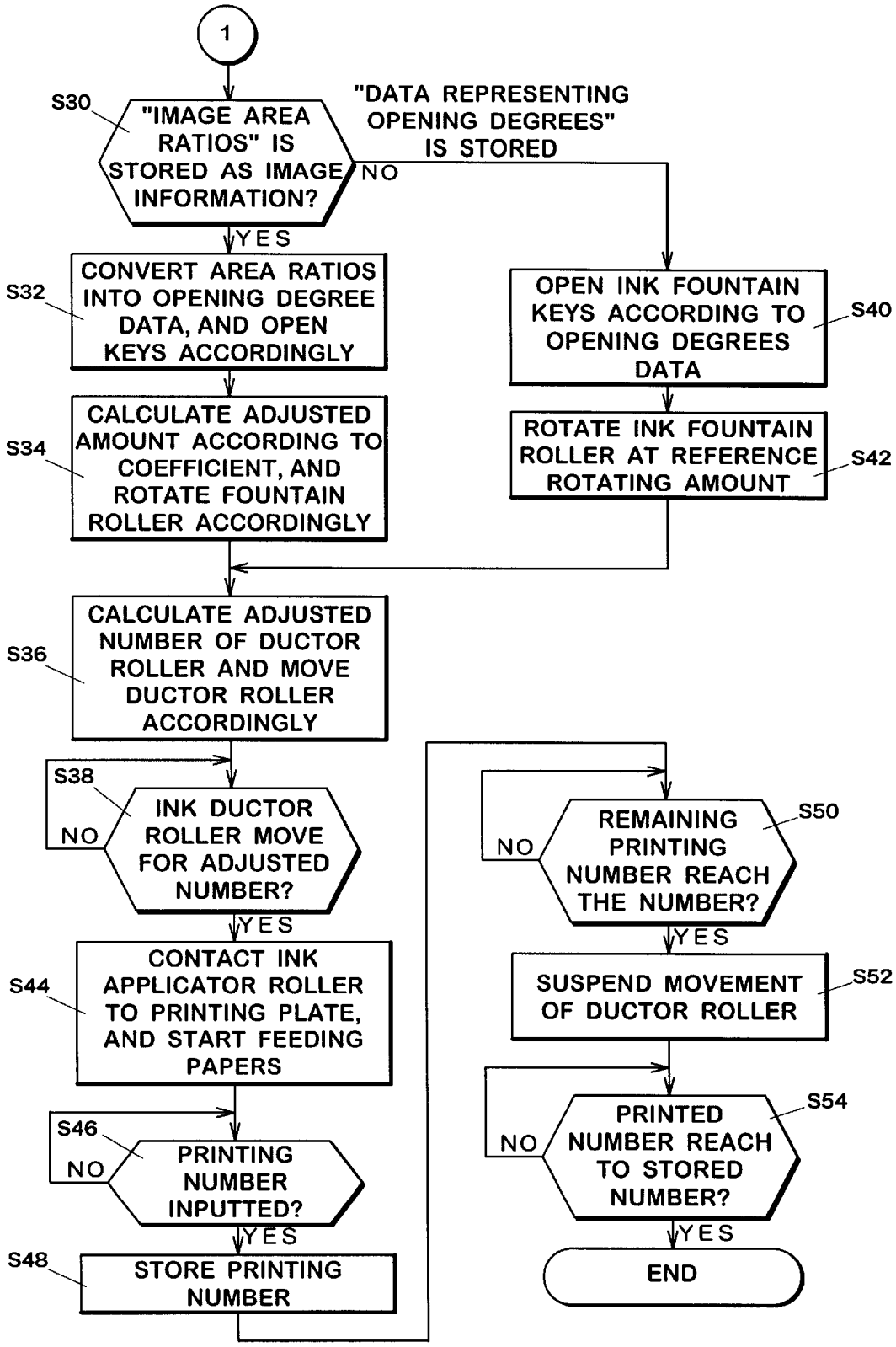
FIG. 3 is another flow chart disclosing the program stored in the ROM 12 shown in FIG. 1.

The first embodiment of an ink supply control device and a method therefor according to the present invention will be described with reference to the accompanying drawings. FIG. 1 is a diagram showing a hardware structure of the main portion of an inking unit 50, and FIGS. 2 and 3 are flow charts disclosing a program stored in a ROM 12 shown in FIG. 1.

Figure 4A:
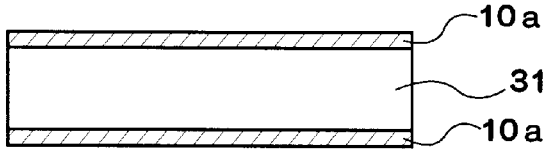
FIGS. 4A and FIG. 4C are views illustrating ink volumes distributed on an ink roller group 30.
Figure 4B:
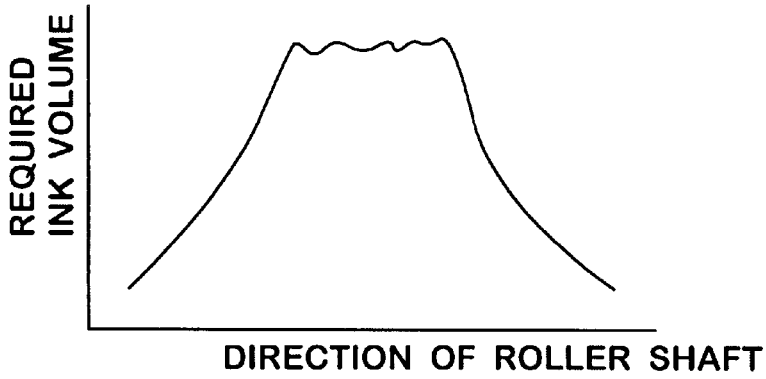
FIG. 4B is a graph illustrating ink volumes required corresponding to the contents of a printing plate 7.
Figure 4C:
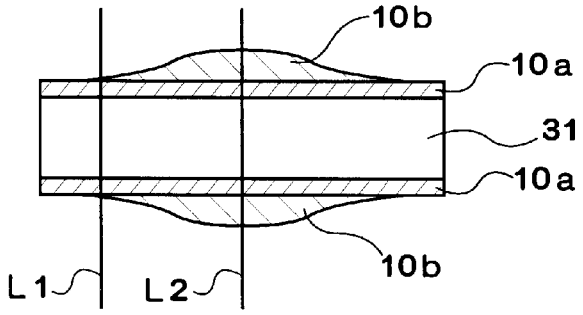

FIGS. 4A and 4C are views illustrating ink volumes distributed on an ink roller group 30, FIG. 4B is a graph illustrating ink volumes required corresponding to the contents of a printing plate 7, and FIGS. 5A through 5D are views illustrating ink volumes distributed on the ink roller group 30.

Figure 7:
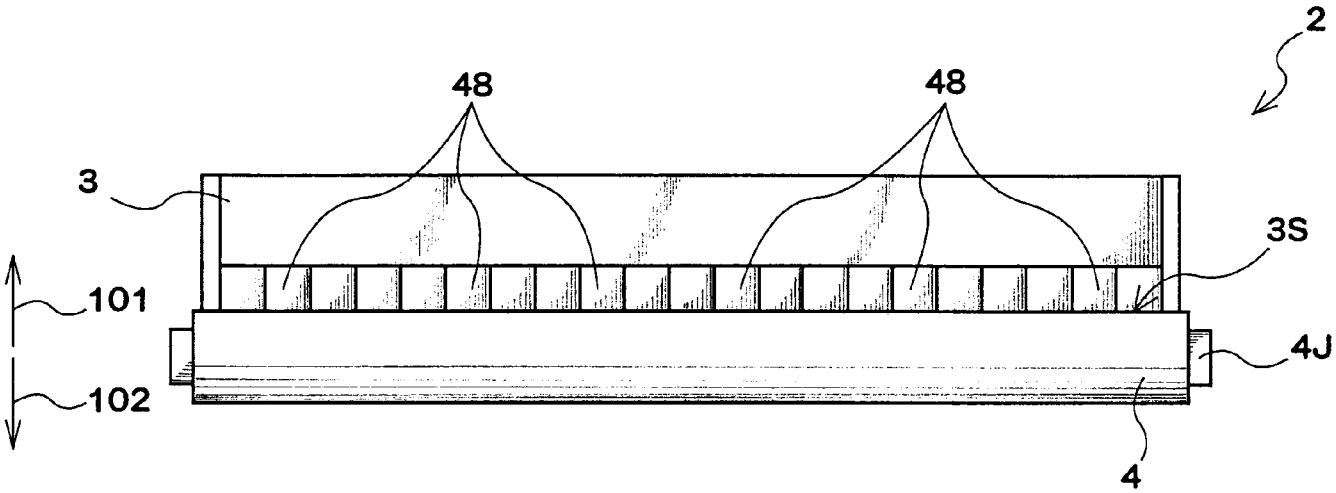
FIG. 7 is a plan view of an ink fountain 2.
Figure 8:
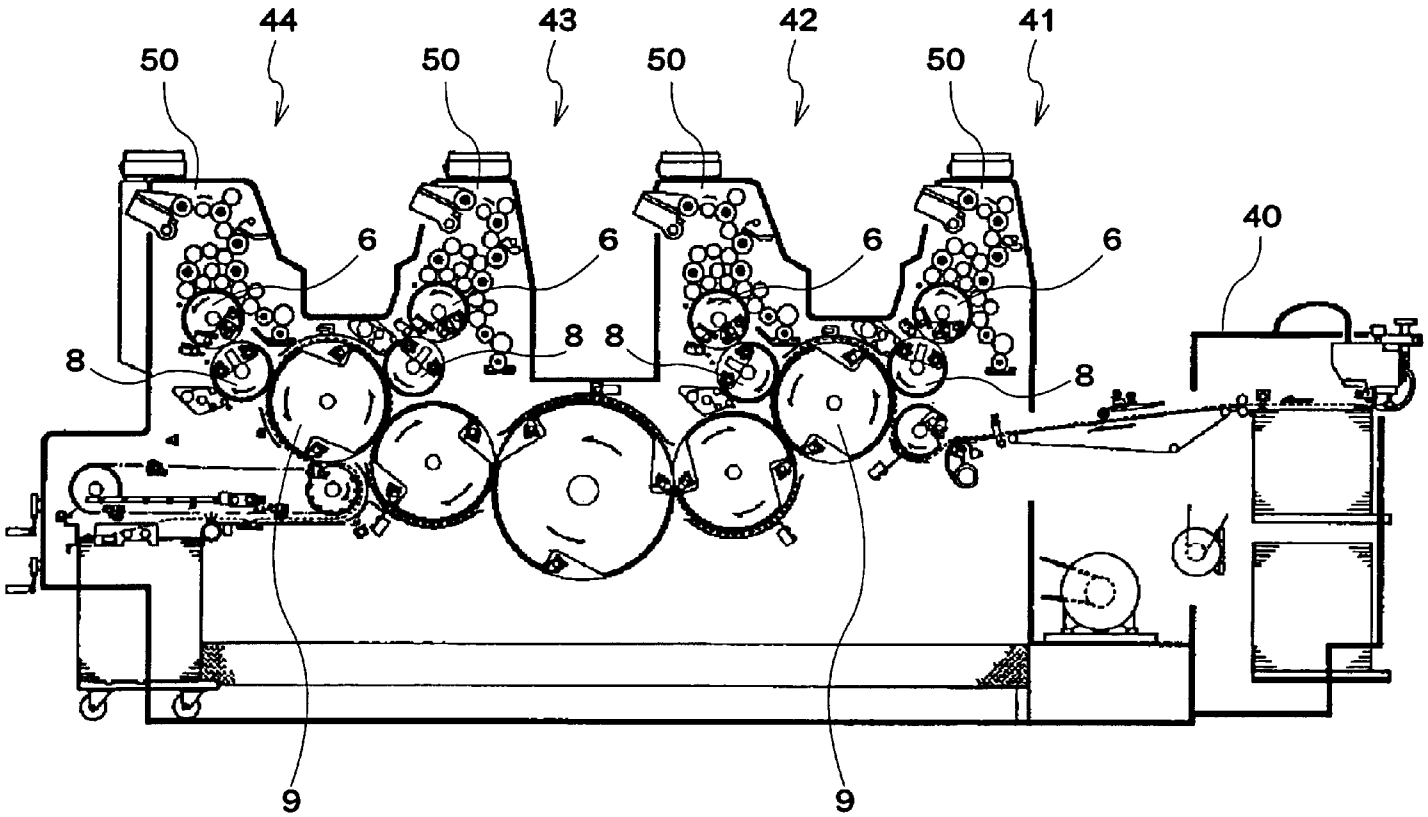
FIG. 8 is a side view showing the overall structure of a four color offset press.
Figure 9:
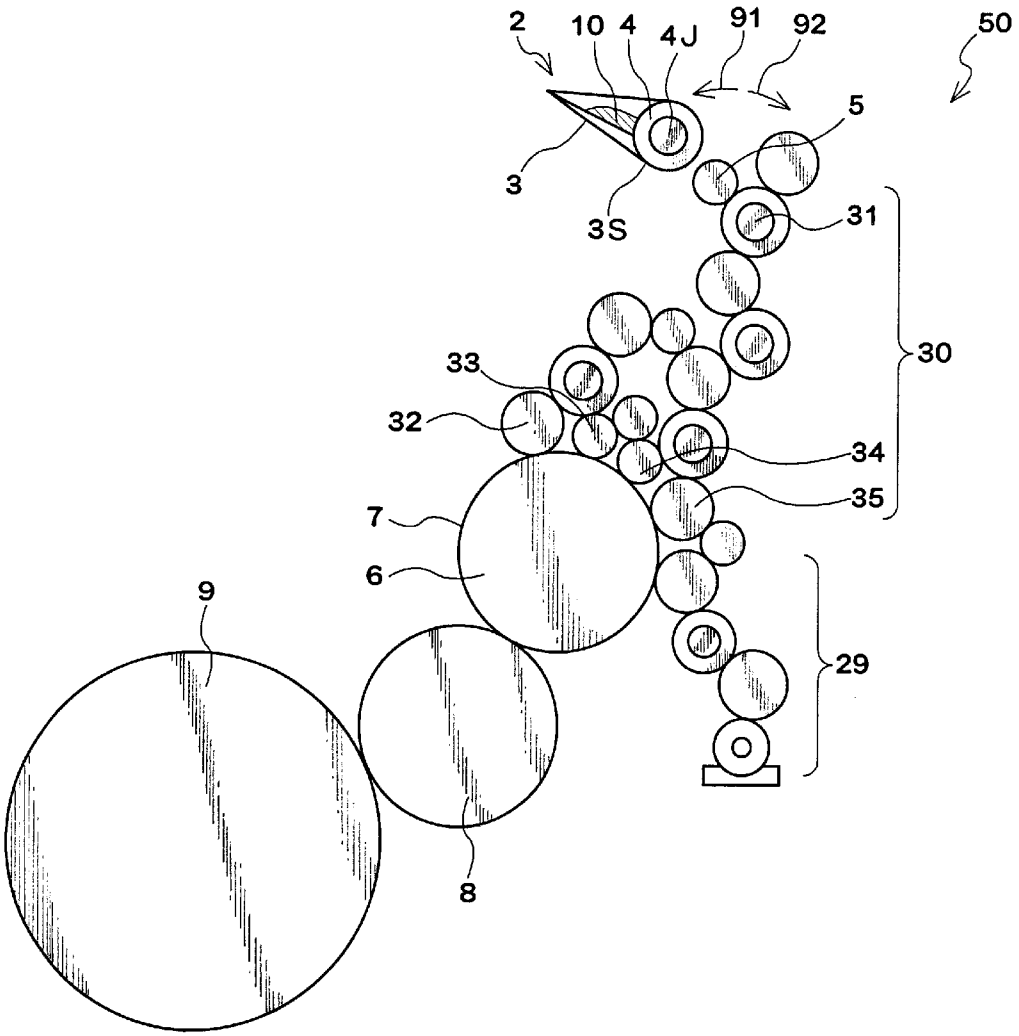
FIG. 9 is a side view showing the typical structure of the inking unit 50.

Further, FIG. 6 is a table representing a relationship between kind of papers to be printed and paper coefficient stored in the ROM 12. Also, FIG. 7 is a plan view of an ink fountain 2, and FIG. 8 is a side view showing the overall structure of a four color offset press. For simplicity, detailed structure of the offset press is omitted in FIG. 8. FIG. 9 is a side view showing the typical structure of the inking unit 50.

(1-1) The Overall Structure of the Inking Device 50

The offset press comprises a feeder 40, a first printing unit 41, a second printing unit 42, a third printing unit 43, and a fourth printing unit 44 as shown in FIG. 8. Each of the printing units includes a plate cylinder 6, and a printing plate 7 disposed on the plate cylinder 6 (see FIG. 9).

Unique images(s) for multi-color printing is formed on each of the printing plates 7 disposed on the plate cylinders 6 in these printing units. Sequential printing is carried out with the printing units 41, 42, 43 and 44 on a printing paper fed from the feeder 40, and the printing paper on which the multi-color printing is carried out, is delivered to a delivery table upon completion of the printing work at the fourth printing unit 44. The plate cylinders 6 provided in each of the printing units are rotatably supported by the main body of the press, and inking unit 50 is provided with respect to each of the plate cylinders 6.

The ink fountain 2 includes both an ink fountain roller 4 and a blade 3 as shown in FIG. 9. The blade 3 comprises a plurality of ink fountain keys 48 divided in the direction of a roller shaft 4J of the ink fountain roller 4. The ink 10 stored in the ink fountain 2 is fed on the external surface of the ink fountain roller 4 through gaps 3S formed between the keys 48 and the roller 4.

Each of the keys 48 is designed so as to control independently in the directions of arrows 101 and 102. When a gap 3S of a specific key 48 is widened as a result of moving the key 48 in a direction of the arrow 101, the ink volume supplied through the gap is increased. On the other hand, ink volume supplied through the gap is decreased when the gap 3S is narrowed as a result of moving the key 48 in a direction of the arrow 102.

Pluralities of ink rollers are included in the ink roller group 30. The ink rollers are rotated around roller shafts each provided parallel to the roller shaft 4J of the ink fountain roller 4. Ink applicator rollers 32, 33, 34, and 35 are designed to move in both directions of accessing and departing to/from the plate cylinder 6 so that either of attachment or detachment of these rollers to the plate cylinder 6 is selected.

An ink ductor roller 5 situated at a position between an ink roller 31 of an ink roller group 30 and the ink fountain roller 4, is reciprocally moved in both directions of arrows 91 and 92, so that the ink 10 fed on the external surface of the ink fountain roller 4 is transferred onto the ink roller 31. The ink 10 thus transferred is supplied to the printing plate 7 disposed on the plate cylinder 6 as a result of sequentially distributing the ink 10 onto the external surface of each ink roller in the group 30 and the ink applicator rollers 32, 33, 34, and 35. A part of the ink rollers in the ink roller group 30 are rotated slidably in a direction of their ink roller shafts slightly.

As described above, movement of the ink keys of the ink fountain 2 is independently controlled so that the gaps 3S can be adjusted on an independent basis. In this way, the ink volume supplied through each of the gaps 3S can independently be adjusted as a result of controlling the ink fountain keys of the ink fountain 2 in independent manner. In this way, a different volume of ink10 corresponding to content of an image on the printing plate 7 can be supplied thereto in a direction of the roller shaft 4J of the ink fountain roller 4. A dampening device 29 is a device for supplying dampening solution to the printing plate 7.

The ink fountain 2, the ink ductor roller 5, and ink roller group 30 form the ink supply portion, and the ink fountain 2 forms the ink source. Also, in this embodiment, the ink ductor roller 5 forms the distribution roller, and the ink fountain roller 4 and the ink fountain roller shaft 4J respectively form the ink source roller and the ink source roller shaft. Further, the ink fountain keys 48 of the ink fountain 2 and the gaps 3S respectively form the opening and closing piece and the gaps in this embodiment.

Image(s) on the printing plate 7 appears thereon as a result of using repulsion occurring between the ink and the dampening solution both supplied to the plate 7. Thus, the ink which appears on the printing plate 7 is transferred onto a rubber blanket cylinder 8. Printing is carried out on a printing paper fed from the feeder 40 and passing between the blanket cylinder 8 and an impression cylinder 9 with the ink transferred onto the blanket cylinder 8.

The minimum volume of ink required for carrying out the printing needs to be distributed on the ink rollers of the ink roller group 30 prior to the printing operation. FIG. 4A shows a primary ink film 10*a* indicative of the minimum volume of ink required by the rollers formed on the ink roller 31. The primary ink film 10*a* is uniformly formed along with a direction of the ink roller shaft.

Figure 5A:
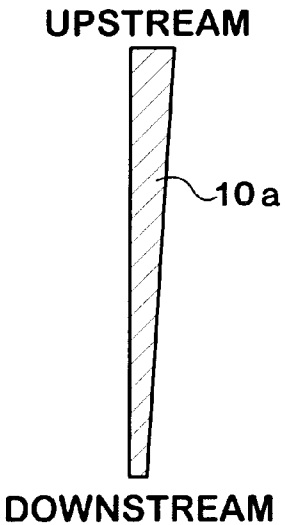
FIGS. 5A through 5D are views illustrating ink volumes distributed on the ink roller group 30.

The ink volume distributed on the ink rollers of the ink roller group 30 gets smaller from the upstream (at a side of the ink roller adjacent to the ink ductor roller 5) to the downstream (at a side adjacent to the plate cylinder 6). FIG. 5A illustrates a volume of the ink 10 distributed on the ink rollers of the ink roller group 30.

Another ink film 10*b* corresponding to the contents of the printing plate 7 is formed on the primary ink film 10*a* in overlapped manner. In the case of requiring the ink distribution on each of the ink rollers shown in FIG. 4B to correspond to the contents of the printing plate 7, the ink film 10*b* is formed on the primary ink film 10*a* in overlapped manner as depicted in FIG. 4C by supplying the ink responding to the graph shown in FIG. 4B as a result of independently controlling each of the keys 48.

Figure 5B:
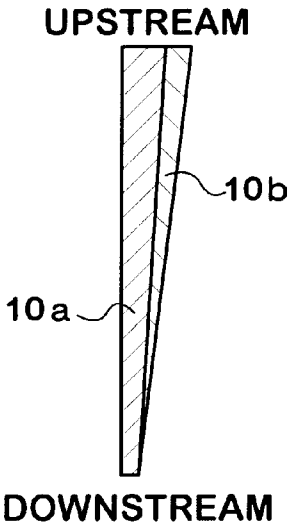
Figure 5C:
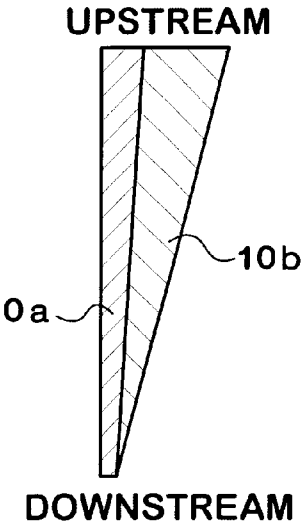

The ink volume of the ink film 10*b* gets smaller from the upstream to the downstream. Both FIGS. 5B and 5C show the ink volume of the ink film 10*b*. FIG. 5B shows the ink volume at a line L1 illustrated in FIG. 4C, and the ink volume at a line L2 illustrated in FIG. 4C is shown in FIG. 5C.

The total volume of supplied ink, the ink volume distributed from the upstream to the downstream, and the gradient of the ink films (see FIGS. 5A, 5B, and 5C) are determined based on the opening degree of the keys 48, the rotating amount of the ink fountain roller 4 (rotation speed), and the number of the reciprocal movement of the ink ductor roller 5. A larger volume of ink is fed on the external surface of the ink fountain roller 4 if the opening degree of the keys 48 is wide. A smaller volume of ink is fed on the external surface of the ink fountain roller 4 if the opening degree of the keys 48 is narrow.

Similarly, a larger volume of ink is fed on the external surface of the ink fountain roller 4 if the rotation speed is fast, and a smaller volume of ink is fed on the external surface of the ink fountain roller 4 if the rotation speed is slow. In addition, the amount of ink transferred from the ink fountain roller 4 to the ink roller 31 may either be increased or be decreased depending upon the number of the reciprocal movement of the ink ductor roller 5.

There are also various kinds of printing papers such as coated papers, mat-coated papers and non-coated papers used in this embodiment. One of coated papers, matcoated papers and non-coated papers are selectively used for the printing papers. Coated papers are papers coated with white clay and the like on the sheet surface in order to make a smooth and shiny surface, and mat-coated papers have a coating but do not have a shiny surface. Non coated papers do not have either treatment.

The ink film transferability depends upon the kind of printing paper used. The coated papers have the best ink film transferability among these papers so that printing can be carried out with less ink volume. Mat-coated papers have ink film transferability following that of the coated papers. Non coated papers have the worst ink film transferability among these papers so that printing requires a greater volume of ink. In this embodiment, the ink volume is automatically controlled depending upon the kind of the printing paper. The mechanisms of carrying out the automatic control will be described later.

(1-2) Hardware Structure of the Inking Device 50

Subsequently, the hardware structure of inking device 50 is described. As shown in FIG. 1, a CPU 11, a ROM 12 and a RAM 13 are coupled to a bus line 14. The CPU 11 controls all the related parts in accordance with the program stored in the ROM 12. In ROM 12, a table depicted in FIG. 6 which represents a relationship between the kind of papers to be printed and the paper coefficient, is stored. As shown in FIG. 6, the paper coefficients are set in ascending manner from the coated papers having a good ink film transferability to the non-coated papers having a poor ink film transferability. The ROM 12 forms a paper coefficient storing portion in this embodiment.

A main machine control unit 15 and a feed control unit 16 are coupled to the bus line 14 via an I/O interface 25. The main machine control unit 15 controls the rotation of plate cylinders mounted in each of the printing units and that of the ink rollers. The feed control unit 16 controls feeding operations carried out with the feeder 40 shown in FIG. 8.

Further, an ink applicator rollers control unit 28, an ink fountain keys control unit 21, an ink fountain roller control unit 22, an ink ductor roller control unit 23, and a flexible disk drive 24 are coupled to the bus line 14 via the I/O interface 25. The ink applicator rollers control unit 28 controls either of attachment or detachment of the ink applicator rollers 32, 33, 34, and 35 of the ink roller group 30 to the plate cylinder 6.

The ink fountain keys control unit 21 independently controls the movement of each key 48 in the ink fountain 2, and the ink fountain roller control unit 22 controls the rotating amount of the ink fountain roller 4. In this embodiment, the ink fountain rollers 4 are rotated with a dedicated motor separately provided from a main motor which rotates the plate cylinders and the rollers. The ink fountain control unit 22 controls the dedicated motor. The ink ductor roller control unit 23 controls the reciprocal movement of the ink ductor roller 5 such as suspension of its movement and the number of the movement.

Further, a paper-type input portion 17, a starting pattern input portion 18, a main machine starting input portion 19, a inking starting input portion 20 are coupled to the bus line 14 through the I/O interface 25. The operator selectively inputs the kind of printing paper through the input portion 17. The operator further inputs the details of inking (such as either of a pattern "start-inking" or "preset-inking") through the starting pattern input portion 18. The CPU 11 starts performing its control according to these inputs upon recognizing the inputs. The input portion 17 forms an input portion in this embodiment.

The CPU 11 also controls the main machine control unit 15 on recognizing an input from the main machine starting input portion 19 in the case of inputting the input through the input portion 19 therethrough by the operator. Further, an inking operation is carried out as a result of controlling the ink fountain key controller 21, the ink fountain roller 22, and the ink ductor roller controller 23 with the CPU 11 when an input therefor is performed through the inking starting input portion 20 by the operator.

All of the input portion 17, the starting pattern input portion 18, the main machine starting input portion 19, the inking starting input portion 20, the ink fountain key controller 21, the ink fountain roller controller 22, and the ink ductor roller controller 23 are provided to each of the printing units shown in FIG. 8. Only the controls in the first printing unit will be described hereunder.

Details of the controls in each of the second printing unit 42, the third printing unit 43, and the fourth printing unit 44 are omitted herein because the performance of these printing units is the same as that of the first printing unit 41.

(1-3) Flowchart of Inking Operation

Subsequently, details of the program stored in the ROM 12 will be described with reference to flowcharts shown in FIGS. 2 and 3. At first, the CPU 11 judges whether or not the kind of the printing paper is inputted through the paper-type input portion 17 (step S2). The paper-type input portion 17 is formed on an operational panel as buttons. A total of three buttons such as a coated-paper selection button, a mat-coated paper selection button, and a non coated-paper selection button are provided on the panel in this embodiment.

The operator pushes one of the buttons according to the kind of the printing paper used for the upcoming printing (the printing papers received in the feeder 40). An assumption is made that non coated papers are received in the feeder 40. The CPU 11 recognizes the selection of "non coated paper" inputted with the non coated-paper selection button through the I/O interface 25 so that the selection of "non coated paper" is stored in the RAM 13. (Step S4).

Subsequently, the CPU 11 retrieves image information (step S6). The image information is information on an ink volume required corresponding to the image(s) on the printing plate 7. In this embodiment, the image information is read out from a flexible disk inserted in the flexible disk drive 24.

When image area ratios shown in FIG. 4B are stored in the flexible disk as image information, data of the image area ratios need to be converted into an opening degrees of each key 48 of the ink fountain 2 at a later step. The image area ratios shown in FIG. 4B can be obtained by scanning the images(s) on the printing plate 7 with an image reader prior to disposing it on the plate cylinder 6.

In this embodiment, the data thus obtained with the image reader is first stored on the flexible disk and then retrieved by the offset press through the flexible disk drive 24. However, the image area ratios may also be retrieved on-line by connecting between the image reader and the offset press.

Further, there is a case in which the flexible disk stores converted data representing opening degrees of the keys 48 as the image information. For example, image area ratios have already been converted into data representing opening degrees of the keys at the previous printing operation when the printing plate 7 which was already used at the previous printing operation is used again for an upcoming printing operation (re-printing). Therefore, no data conversion at a later step is required because the converted data representing opening degrees of the keys are stored in the flexible disk.

Upon retrieving the image information at the step S6, the CPU 11 judges whether or not a starting pattern of inking operation is inputted through the starting pattern input portion 18 (step S8). The operator selects one of the two starting patterns such as the "start-inking" or the "preset-inking" through selection buttons provided on the operation panel.

The "start-inking" is selected when no ink is distributed on the ink rollers of the ink roller group 30, that is rollers in the ink roller group 30 are clean (such as at the hour the plant opens). On the contrary, "preset-inking" is selected when a certain volume of ink is distributed on the ink rollers of the ink roller group 30 (in the case of carrying out another printing operation after changing the printing plate 7). The CPU 11 recognizes an input of the starting pattern through the I/O interface 25 and stores the input into the RAM 13 when one of the patterns is inputted to the starting pattern input portion 18 (step S10).

The CPU 11 provides a signal for starting the operation of the main machine to the main machine control unit 15 when the operator inputs a starting command of the main machine using the main machine starting input portion 19 (step S12, S14). Then, the CPU 11 recognizes the starting pattern stored at step S10 as a result of proceeding its process to step S18 from step S16 when details of inking "start-inking" is inputted by the operator through the inking starting input portion 20.

When the "start-inking" is selected as the starting pattern (such as at the hour the plant opens or the like), the process proceeds to steps following to step S20 because no ink is distributed on the ink rollers. An ink film 10*a* (see FIGS. 4A, 5A) representing a minimum amount of ink required for the ink rollers is formed at the steps following step S20.

The CPU 11 outputs a signal to the ink fountain key controller 21 through the I/O interface 25 in order for each of the ink keys 48 of the ink fountain 2 to open a predetermined initial opening degree according to the signal (step S20). In this embodiment, 10% is predetermined as the initial opening degree of the keys. All the ink keys open in parallel manner at 10% in the opening degree. The opening degree is indicated in percentages where the maximum opening of the keys 48 is 100%.

Subsequently, the CPU 11 provides a signal to the ink fountain roller controller 22 via the I/O interface 25 in order for the ink fountain roller 4 to rotate at a predetermined reference rotating amount (step S22). In this embodiment, 40% is predetermined as the reference rotating amount. The rotating amount of the ink fountain roller 4 is indicated in percentages where the maximum rotating amount thereof is 100%.

Thereafter, the CPU 11 provides a signal to the ink ductor roller control unit 23 through the I/O interface 25 in order for the ductor ink roller 5 to move reciprocally (step S24). Then, a judgement is carried out whether or not the number of reciprocal movement of the ductor roller 5 reaches to a predetermined initial number (step S26). In this embodiment, eighty (80) times are predetermined as the initial number of the reciprocal movement. By carrying out steps S20 through S26 described above, ink films 10*a* (see FIGS. 4A, 5A) are formed on each of the ink rollers of the ink roller group 30.

When the "preset-inking" is selected as the starting pattern (in the case of carrying out another printing operation after changing the printing plate 7) at step S10, the process proceeds to step S28 from step S18 because a certain amount of ink is distributed on the ink rollers. The amount of ink distributed on the ink rollers is referred to as the certain volume of ink existing on each roller of the ink roller group in this embodiment.

A judgement is required whether or not the number of rotations of the ink rollers reaches to a predetermined idling number at step S28, and then the process proceeds to the next step when the number reaches the idling number. In this embodiment, fifty (50) times are predetermined as the idling number. The main machine has already started its operation at step S14 so that the ink rollers are rotated. At that time, the ink applicator rollers 32, 33, 34, and 35 are not in contact with the printing plate 7 because these rollers are apart from the plate cylinder 6.

Figure 5D:
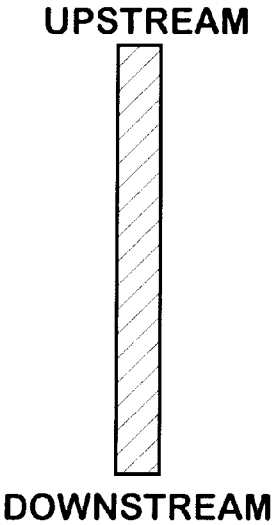

As a consequence, the certain volume of ink existing on each roller of the ink roller group is uniformalized across the ink rollers located from the upstream to the downstream while carrying out the idling operation (see FIG. 5D). Further, the ink volume on the ink rollers may be uniformalized in the direction of their shaft because a part of the ink rollers of the ink roller group 30 are slidably rotated on the ink roller shaft. In this way, ink appropriate for the contents of the printing plate 7 used for the current printing operation can quickly be supplied effectively in a later step.

Next, the CPU 11 judges whether or not the image information stored at step S6 is "image area ratios" (step S30). In the case of storing the image information as "image areas ratios" , the process proceeds to step S32, and the image area ratios are converted into data representing opening degrees of the keys 48.

The CPU 11 outputs a signal to the ink fountain key controller 21 in order for the controller 21 to independently control the opening degree of the keys 48 according to the data. As a consequence, ink 10 corresponding to content of the images(s) on the printing plate 7 can be supplied in a direction of the roller shaft 4J (see FIG. 4C).

Thereafter, the CPU 11 calculates an adjusted rotating amount by multiplying a paper coefficient corresponding to the kind of paper stored at step S4 by the reference rotating amount (40%) at step S34. In this case, an adjusted rotating amount of 48% is figured out as a result of multiplying a paper coefficient "1.2" corresponding to non coated paper according to the table shown in FIG. 6 by 40% in the rotating amount because the use of non-coated paper is stored previously. A larger volume of ink 10 is fed from the ink fountain 2 by rotating the ink fountain roller at a rotating amount of 48% because the non-coated printing papers have a poor ink film transferability.

A smaller volume of ink 10 is fed by rotating the ink fountain roller at a rotating amount of 40% calculated as a result of multiplying the reference rotating amount by a paper coefficient "1" if coated paper is selected at step S2 because the coated printing papers have a good ink film transferability.

In addition, the ink fountain roller is rotated at a rotating amount of 44% calculated as a result of multiplying the reference rotating amount by a paper coefficient "1.1" if mat coated paper is selected at step S2. An intermediate volume of ink 10 is fed from the ink fountain because the mat coated papers have less ink film transferability than that of the coated papers and better ink film transferability than that of the non-coated papers.

Thereafter, the process proceeds to step S36 in which the adjusted number of reciprocal movement of the ink ductor roller 5 is calculated by multiplying a reference number of the reciprocal movement (ten (10) times in this embodiment) by the paper coefficient stored in step S4 corresponding to the kind of the paper stored at step S4. In this case, twelve (12) times is obtained as the adjusted number of reciprocal movement of the ink ductor roller 5 as a result of multiplying the reference number (ten (10) times) by the paper coefficient "1.2" corresponding to the non-coated paper according to the table shown in FIG. 6.

Ink 10 is distributed to the ink roller 31 from the ink fountain roller 4 by reciprocally moving the ductor roller 5 twelve (12) times. A large volume of ink 10 is distributed on the ink rollers of the ink roller group 30 because the non-coated printing papers have a poor ink film transferability. Therefore, more volume of the ink 10 is distributed on the ink roller 31 by reciprocally moving the ink ductor roller 5 twelve (12) times.

A smaller volume of ink 10 is fed by reciprocally moving the ink ductor roller 5 ten (10) times if coated paper is selected at step S2 because the coated printing papers have a good ink film transferability.

In addition, the ink ductor roller 5 is reciprocally moved eleven (11) times as a result of multiplying the reference number by the paper coefficient "1.1" if mat coated paper is selected at step S2. An intermediate volume of ink 10 is fed because the mat coated papers have less ink film transferability than that of the coated papers and better ink film transferability than that of the non-coated papers.

In the case of storing the image information at step S6 as "data representing opening degrees", the process proceeds to step S40 from step S30, and the CPU 11 outputs a signal to the ink fountain key controller 21 in order for each of the ink keys 48 to independently open in accordance with the signal. As a consequence, ink 10 corresponding to the content of the image(s) on the printing plate 7 can be supplied in a direction of the roller shaft 4J (see FIG. 4C).

Thereafter, the process proceeds to step S42 in which the ink fountain roller 4 is rotated at the reference rotating amount 40%. At step S42, however, there is no multiplication of the reference rotating amount by the paper coefficient which is unlike step S34 described earlier.

The reason for retrieving the data representing the opening degrees as image information, is that the printing plate 7 is used at the previous printing operation. Therefore, an appropriate ink volume corresponding to the printing paper is considered as the volume being set and adjusted by the operator in this embodiment. That is, the ink fountain roller 4 is rotated at the reference rotating amount similar to the previous printing operation in order to carry out another printing operation close enough to the previous printing operation. In the case of using the offset press according to the present invention, an adjusted rotating amount may be figured out even at step S42 as a result of multiplying a paper coefficient by the reference rotating amount similar to step S34.

On rotating the ink fountain roller 4 at the reference rotating amount at step S42, the process proceeds to step S36 where the adjusted number of reciprocal movement of the ink ductor roller 5 is calculated by multiplying the reference number of the reciprocal movement by the paper coefficient, and the ink ductor roller 5 is operated accordingly.

The CPU 11 provides both a signal to the ink applicator rollers control unit 28 in order for the ink applicator rollers 32, 33, 34, and 35 to move into contact with the printing plate 7 and a signal to the feed control unit 16 for starting paper feed from the feeder 40 when the ink ductor roller 5 is reciprocally moved for the adjusted number calculated at step S36 (step S44).

Thereafter, the operator inputs a printing number via a printing number input portion (not shown) on confirming good printing conditions from his/her inspection. For example, it is assumed that a total of 1,000 pieces is inputted as the printing number, and the number is stored in the RAM 13 (steps S46, S48).

In this way, images for multi-color printing are printed respectively on the printing papers with the first printing unit 41, the second printing unit 42, the third printing unit 43, and the fourth printing unit 44 as a result of starting the printing operation. In order to exhaust as much ink 10 distributed on the ink roller group 30 as possible, reciprocal movement of the ink ductor roller 5 is suspended from supplying ink 10 to the ink roller 31 when the number of remaining printing papers to be printed reaches the predetermined number for ink exhaustion in this embodiment (steps S50, S52).

In this embodiment, the predetermined number for ink exhaustion is defined as twenty (20) pieces. In other words, the CPU 11 outputs a signal to the ink ductor roller controller 23 for the ink ductor roller 5 to suspend its movement when the number of printed papers reaches a total of 980 pieces calculated as a result of subtracting the predetermined number of 20 pieces from the printing number of 1,000 pieces stored at step S48. Printing papers according to the predetermined number are the printing papers used for exhaustion of the ink in this embodiment.

Thereafter, the printing operation for exhausting the ink is carried out through the print of the printing paper of 981th to 1,000th under a condition of suspending distribution of the ink 10 from the ink fountain 2 to the ink roller group 30. In this way, the ink 10 distributed on the ink rollers of the ink roller group 30 is used for carrying out the printing operation for exhausting the ink. The predetermined number is defined as a number not causing any degradation of printing accuracy. The printing work ends when the number of printed papers reaches the number stored at step S48 (step S54).

2. Second Embodiment

Subsequently, the second embodiment of an ink supply control device and a method therefor according to the present invention will be described. Although, the predetermined number for ink exhaustion is a fixed number of 20 pieces shown in FIG. 3 regardless of the kind of the printing paper in the first embodiment, an adjusted predetermined number is defined in accordance with the paper coefficient listed in the table shown in FIG. 6 in this embodiment.

In other words, the paper coefficient "1.2" corresponding to non-coated paper is multiplied by 20 pieces when the kind of the paper stored at step S4 is non-coated paper so that an adjusted predetermined number of 24 pieces is calculated. The reciprocal movement of the ink ductor roller 5 is suspended when the number of remaining printing papers to be printed reaches 24 pieces.

A large volume of ink 10 is distributed on the ink rollers of the ink roller group 30 as in the first embodiment because the non-coated printing papers have a poor ink film transferability. In order to exhaust as much ink 10 distributed on the ink roller group 30 as possible, the reciprocal movement of the ink ductor roller 5 is suspended when the number of remaining printing papers to be printed reaches 24 pieces.

Further, another predetermined number for ink exhaustion of 20 pieces is used as it is when the kind of the paper stored at step S4 shown in FIG. 2 is coated paper as a result of multiplying the paper coefficient "1" by 20 pieces. The ink 10 distributed on the ink roller group 30 can be exhausted even when the movement of the ink ductor roller 5 is suspended at the remaining number of 20 pieces similar to the first embodiment because a smaller volume of ink is distributed on the ink group 30.

Further, another predetermined number for ink exhaustion of 22 pieces is used as a result of multiplying the paper coefficient "1.1" by 20 pieces when the kind of paper stored at step S4 shown in FIG. 2 is mat coated paper. An intermediate number such as 22 pieces between 24 pieces and 20 pieces is used when mat-coated papers are used as the printing papers because an intermediate volume of ink 10 is distributed on the ink roller group 30. The outstanding structures of the offset press in this embodiment are the same as that of the offset press in the first embodiment.

3. Third Embodiment

Next, the third embodiment of an ink supply control device and a method therefor according to the present invention will be described. The movement of the ink roller 5 is suspended when the remaining printing number reaches a predetermined number and the adjusted predetermined number in the first and the second embodiments, respectively, as described earlier.

In this embodiment, however, no adjusted predetermined number is defined, and the ink ductor roller 5 continues its reciprocal movement until the number of printed papers reaches the printing number stored at step S48 shown in FIG. 3 described in the first embodiment.

The ink 10 distributed on the ink roller group 30 is exhausted with sheets fed to remove the ink (waste paper) by continuously feeding the printing papers under a condition of suspending the movement of the ink ductor roller 5 after completing print of the printing number. The sheets fed to remove the ink are printing papers for exhaustion of the ink in this embodiment.

The number of the sheets to be fed to remove the ink is set as the number for removing ink (for example, 20 pieces) prior to the printing operation. In this embodiment, an adjusted number of sheets fed to remove ink is calculated in accordance with the papers coefficient listed on table 1 of the first embodiment.

In other words, the paper coefficient "1.2" corresponding to non-coated paper is multiplied by 20 pieces when the kind of the paper stored at step S4 shown in FIG. 2 is non-coated paper so that an adjusted number of sheets fed to remove ink is calculated as 24 pieces. Paper feed is suspended when a total of 24 pieces of the sheets fed to remove ink are fed.

A large volume of ink 10 is fed to the ink rollers of the ink roller group 30 as in the first embodiment because the non-coated printing papers have a poor ink film transferability. In this way, paper feed is suspended when a larger number of the sheets such as 24 pieces are fed because a larger volume of ink is distributed on the ink roller group 30.

Further, another adjusted number of sheets fed to remove ink, a total of 20 pieces are used as it is when the kind of the paper stored at step S4 shown in FIG. 2 is coated paper as a result of multiplying the paper coefficient "1" by 20 pieces. A smaller volume of ink is fed to the ink group 30 as in the first embodiment when coated papers are used for the printing. In this way, since a smaller volume of ink is distributed on the ink roller group 30, it can be removed sufficiently with 20 pieces of the sheets fed to remove ink.

In addition, another adjusted number of sheets fed to remove ink, a total of 22 pieces are used when the kind of the paper stored at step S4 is mat coated paper as a result of multiplying the paper coefficient "1.1" by 20 pieces. An intermediate volume of ink 10 is fed to the ink roller group 30 when the mat coated papers are used as in the first embodiment. In this way, an intermediate number of the sheets such as 22 pieces between 24 pieces and 20 pieces are fed because the ink distributed on the ink roller group 30 is an intermediate volume. The outstanding structures of the offset press in this embodiment are the same as that of the offset press in the first embodiment.

4. Other Embodiments

The adjusted rotating amount for the rotating amount of the ink fountain roller 4 and the adjusted number of reciprocal movement for the number of reciprocal movement of the ductor roller 5 are respectively calculated at steps S34 and S36 in accordance with the paper coefficient in the embodiments described above. However, an adjusted opening degree of the keys may also be calculated by multiplying one of the data representing opening degrees of the keys obtained at step S32 and that used at step S40.

In other words, an appropriate volume of ink responding to the kind of printing paper can be supplied by correspondingly adjusting the opening degree of the ink fountain keys with the printing paper to be used because the ink volume fed to the rollers is varied depending on the opening degree of the ink fountain keys. Further, operations in consideration of one or two of the following factors, such as, the opening degree of the ink fountain keys, the rotating amount of the ink fountain roller 4, and the number of reciprocal movement of the ductor roller 5 to the paper coefficient, may be performed.

Although a total of three kinds of papers such as coated papers, mat coated papers, and non-coated papers are used as the printing papers in the above embodiments, other kind of papers may also be used as the printing papers. Less or more than three kinds of papers such as two kinds or four kinds may further be used. The adjusted values are calculated by multiplying the paper coefficient in the embodiment described above. Any other calculation method may also be used if the adjusted values are calculated in accordance with the coefficient.

The ink fountain keys used in the above embodiments are divided in a plurality of cells, the present invention may also be applied to an ink supply control device including an ink fountain key which is not divided into a plurality of cells.

5. Advantages of the Present Invention

The ink supply control device for printing machines according to the present invention is characterized in that, a paper coefficient storing portion stores a plurality of paper coefficient uniquely determined corresponding to kinds of printing papers, and a kind of the printing paper to be printed is inputted through the input portion. A paper coefficient corresponding to the kind of the printing paper inputted through the input portion is selected from the paper coefficient stored in the paper coefficient storing portion, and the ink supply portion controls supply of an ink volume to the printing plate in accordance with the selected coefficient.

In this way, appropriate controls with certainty can easily be carried out in accordance with the kind of the printing paper because the ink supply is controlled in accordance with the paper coefficient stored in the storing portion.

The ink supply control device for printing machines according to the present invention is characterized in that, the supply of an ink volume from the ink source to one of the ink roller and the ink roller group is adjusted in accordance with the coefficient selected from the paper coefficient stored in the paper coefficient storing portion.

In this way, appropriate controls with certainty can easily be carried out in accordance with the kind of the printing paper because the supply of the ink volume from the ink source to one of the ink roller and the ink roller group is adjusted in accordance with the paper coefficient stored in the storing portion.

The ink supply control device for printing machines according to the present invention is characterized in that, a paper coefficient storing portion stores a plurality of paper coefficient uniquely determined corresponding to kinds of printing papers, and a kind of the printing paper to be printed is inputted through the input portion. A paper coefficient corresponding to the kind of the printing paper inputted through the input portion is selected from the paper coefficient stored in the paper coefficient storing portion and at least one of the rotation of the ink source roller, the opening and closing operations of the piece, and the reciprocal movement of the distribution roller is controlled in accordance with the selected coefficient.

In this way, appropriate controls with certainty can easily be carried out in accordance with the kind of the printing paper because at least one of the rotation of the ink source roller, the opening and the closing operations of the piece, and the reciprocal movement of the distribution roller is controlled in accordance with the paper coefficient stored in the storing portion.

The ink supply control device for printing machines according to the present invention is characterized in that, the control device carries out a printing operation for exhausting the ink distributed on the ink roller group under a condition of suspending distribution of the ink to the ink rollers while contacting the ink rollers with the printing plate when a predetermined number of printed paper are printed. Then, the control device determines number of printing papers used for the printing operation for exhausting the ink in accordance with the kind of the printing paper inputted through the input portion.

In this way, the ink distributed on the ink roller group in accordance with the contents of the image on the printing plate is exhausted because the control device carries out the printing operation for exhausting the ink when the predetermined number of the printed paper are printed. Ink appropriate for contents of another printing plate used for the upcoming printing operation quickly can be supplied effectively.

In addition, an appropriate number of printing papers for exhaustion of the ink can be selected because the number of the printing papers for ink exhaustion is determined in accordance with the kind of the printing paper. As a consequence, waste of the printing papers for the ink exhaustion may be suppressed while exhausting the ink with certainty.

The control method of ink supply to printing machines according to the present invention is characterized in that, a kind of the printing paper to be printed is inputted, and the supply of the ink volume to the printing plate is controlled in accordance with a paper coefficient corresponding to the kind of the printing paper inputted.

In this way, appropriate controls with certainty can easily be carried out in accordance with the kind of the printing paper because the supply of the ink volume is controlled in accordance with the paper coefficient obtained correspondingly to the kind of the inputted printing paper.

The control method of ink supply to printing machines according to the present invention is characterized in that, a kind of the printing paper to be printed is inputted, and at least one of the rotation of the ink source roller, the opening and closing operations of the piece, and the reciprocal movement of the distribution roller is controlled in accordance with the coefficient obtained correspondingly to the kind of the inputted printing paper.

In this way, appropriate controls with certainty can easily be carried out in accordance with the kind of the printing paper because at least one of the rotation of the ink source roller, the opening and the closing operations of the piece, and the reciprocal movement of the distribution roller is controlled in accordance with the paper coefficient obtained correspondingly to the kind of the inputted printing paper.

The control method of ink supply to printing machines according to the present invention is characterized in that, the printing machine carries out a printing operation for exhausting the ink distributed on the ink roller group under a condition of suspending distribution of the ink to the ink rollers while contacting the ink rollers with the printing plate when a predetermined number of printed paper are printed. Then, the number of printing papers used for the printing operation for exhausting the ink is determined in accordance with the kind of the inputted printing paper.

In this way, the ink distributed on the ink roller group in accordance with the contents of the image on the printing plate is exhausted because the printing machine carries out the operation for exhausting the ink when the predetermined number of the printed paper are printed. Ink appropriate for contents of another printing plate used for the upcoming printing operation can quickly be supplied effectively.

In addition, an appropriate number of printing papers for exhaustion of the ink can be selected because the number of the printing papers for ink exhaustion is determined in accordance with the kind of the printing paper. As a consequence, waste of the printing papers for the ink exhaustion may be suppressed while exhausting the ink with certainty.

The control method of ink supply to printing machines according to the present invention is characterized in that, a certain volume of ink exists on each roller of the ink roller group, and each roller of the ink roller group is rotated for a predetermined period under a condition of suspending distribution of the ink to the ink roller group while not supplying the ink to the printing plate from the ink roller group. Further, another volume of ink corresponding to content of an image on the printing plate is supplied to the printing plate along with the ink source roller shaft as a result of correspondingly performing the opening and closing operations of the piece to the contents of the image on the printing plat after elapsing the predetermined period.

In other words, the volume of the ink supplied to each roller of the ink roller group is uniformalized because each roller of the ink roller group is rotated for the predetermined period under the condition of suspending distribution of the ink to the ink roller group while not supplying the ink to the printing plate from the ink roller group. In this way, ink appropriate for contents of the printing plate can quickly be supplied effectively when the ink correspondingly supplied to the contents thereof is supplied to the printing plate.

The control method of ink supply to printing machines according to the present invention is also characterized in that, a kind of the printing paper to be printed is inputted, and at least one of the rotation of the ink source roller, the opening and closing operations of the piece, and the reciprocal movement of the distribution roller is controlled in accordance with the coefficient obtained correspondingly to the kind of the inputted printing paper.

In this way, appropriate controls with certainty can easily be carried out in accordance with the kind of the printing paper because at least one of the rotation of the ink source roller, the opening and the closing operations of the piece, and the reciprocal movement of the distribution roller is controlled in accordance with the paper coefficient obtained correspondingly to the kind of the inputted printing paper.

While the embodiments of the present invention, as disclosed herein, constitute preferred forms, it is to be understood that each term was used as illustrative and not restrictive, and can be changed within the scope of the claims without departing from the scope and spirit of the invention.

What is claimed is:

1. A control method of ink supply to a printing machine, the printing machine including:

an ink source roller rotating around an ink source roller shaft;

an opening and closing piece disposed in a direction extending along the ink source roller shaft and storing ink in a space formed between the piece and the ink source roller, the piece being capable of varying a gap formed between the piece and the ink source roller by carrying out opening and closing operations of the piece thereby ink volume being supplied on an external surface of the ink source roller, an ink roller group for supplying the ink to a printing plate, which is comprised of a plurality of rollers being in contact one with another, each of which rotates around a roller shaft thereof, and a distribution roller capable of moving reciprocally between the ink source roller and the ink roller group, the distribution roller distributing the ink supplied on an external surface of the ink source roller onto external surfaces of the ink roller group, the method comprising the steps of:

inputting a kind of the printing paper to be printed, and controlling at least one of rotation of the ink source roller and reciprocal movement of the distribution roller in accordance with a coefficient corresponding to the kind of the inputted printing paper.

2. The control method in accordance with claim 1, wherein the opening and closing piece is able to supply different volumes of ink along the direction of the ink source roller shaft.

3. The control method in accordance with claim 1, wherein one of a coated paper, a mat coated paper, and a non-coated paper is used as the printing paper.

4. The control method in accordance with claim 3, wherein the paper coefficient of the coated paper, that of the mat coated paper, and that of the non-coated paper are respectively determined as values of "1", "1.1", and "1.2".

5. The control method in accordance with claim 1, wherein the printing machine carries out a printing operation for exhausting the ink distributed on the ink roller group under a condition of suspending distribution of the ink to the ink rollers while contacting the ink rollers with the printing plate when a predetermined number of printing papers are printed, and wherein the method further comprises the step of:

determining a number of printing papers used for the printing operation for exhausting the ink in accordance with the kind of the inputted printing paper.

6. A control method of ink supply to a printing machine, the printing machine including:

an ink source roller rotating around an ink source roller shaft, an opening and closing piece disposed in a direction extending along the ink source roller shaft and storing ink in a space formed between the piece and the ink source roller, the piece being capable of varying a gap formed between the piece and the ink source roller by carrying out opening and closing operations of the piece thereby ink volume being supplied on an external surface of the ink source roller, an ink roller group for supplying the ink to a printing plate, which is comprised of a plurality of rollers being in contact one with another, each of which rotates around a roller shaft thereof, and a distribution roller capable of moving reciprocally between the ink source roller and the ink roller group, the distribution roller distributing the ink supplied on an external surface of the ink source roller onto external surfaces of the ink roller group, the method comprising the steps of;

inputting a kind of the printing paper to be printed, providing a certain volume of ink on each roller of the ink roller group, rotating each roller of the ink roller group for a predetermined period under a condition of suspending distribution of the ink to the ink roller group while not supplying the ink to the printing plate from the ink roller group, supplying another volume of ink corresponding to content of an image on the printing plate in the direction extending along the ink source roller shaft as a result of correspondingly performing the opening and closing operations of the piece according to the content of the image on the printing plate after the predetermined period has elapsed, and controlling at least one of rotation of the ink source roller, opening and closing operations of the piece, and reciprocal movement of the distribution roller in accordance with coefficient corresponding to the kind of the inputted printing paper.

* * * * *